US008181393B2

(12) United States Patent
Talpe

(10) Patent No.: US 8,181,393 B2
(45) Date of Patent: May 22, 2012

(54) LOCK MECHANISM FOR A HINGED LEAF OF A DOUBLE DOOR OR GATE

(76) Inventor: Joseph Talpe, Heestert-Zwevegem (BE)

( * ) Notice: Subject to any disclaimer, the term of this patent is extended or adjusted under 35 U.S.C. 154(b) by 113 days.

(21) Appl. No.: 12/599,015

(22) PCT Filed: May 6, 2008

(86) PCT No.: PCT/EP2008/055523

§ 371 (c)(1),
(2), (4) Date: Nov. 5, 2009

(87) PCT Pub. No.: WO2008/135567

PCT Pub. Date: Nov. 13, 2008

(65) Prior Publication Data

US 2010/0132262 A1 Jun. 3, 2010

(30) Foreign Application Priority Data

May 7, 2007 (EP) ..... 07107635

(51) Int. Cl.
*E05C 9/12* (2006.01)

(52) U.S. Cl. ..... 49/394; 292/66; 292/142; 292/DIG. 20; 292/DIG. 47; 292/39

(58) Field of Classification Search ..... 292/39, 292/112, 142, 160, 279, 22, DIG. 29, DIG. 30, 292/DIG. 31
See application file for complete search history.

(56) References Cited

U.S. PATENT DOCUMENTS 2,431,105 A * 11/1947 Brinson ..... 292/172
2,576,536 A * 11/1951 Reynaud ..... 74/98
4,476,700 A * 10/1984 King ..... 70/99
5,184,852 A 2/1993 O'Brien
5,290,077 A * 3/1994 Fleming ..... 292/35
5,865,479 A * 2/1999 Viney ..... 292/39
5,951,068 A * 9/1999 Strong et al. ..... 292/39
5,992,188 A * 11/1999 Saunders ..... 70/120

(Continued)

FOREIGN PATENT DOCUMENTS

EP 1 411 197 A1 4/2004

(Continued)

*Primary Examiner* — Thomas Beach
*Assistant Examiner* — Sajid R Ansari
(74) *Attorney, Agent, or Firm* — Sughrue Mion, PLLC

(57) ABSTRACT

The lock mechanism comprises a first subunit (6) arranged to be fixed on an outer face of an upright tubular member (7) of the hinged leaf and a second subunit (8) arranged to be fixed within the tubular member (7). The second subunit (8) comprises a frame (9), a bolt member (10) movably mounted on said frame (9) between a projected and a retracted position, and a bolt operating mechanism which comprises a gear train (20, 21, 22) to increase the travel of the bolt member (10). The first subunit (6) comprises operator means (26, 28, 29). The lock mechanism further comprises a rotary shaft (32) by means of which the bolt operating mechanism can be coupled to the operator means so that only a hole has to be made in the tubular member (7) of the leaf. The operator means comprise a hinged lever (26) movable between a pushed in position and a pulled out position, the bolt member (10) moving from its projected to its retracted position when the lever (26) is moved from its pushed in to its pulled out position and vice versa. In this way, the bolt member (10) is locked in its projected position, wherein it extends in a reception hole in the ground, when the double door or gate is closed.

16 Claims, 13 Drawing Sheets

U.S. PATENT DOCUMENTS

| | | | | |
|---|---|---|---|---|
| 6,209,931 | B1 * | 4/2001 | Von Stoutenborough et al. | 292/160 |
| 6,217,087 | B1 * | 4/2001 | Fuller | 292/39 |
| 6,354,639 | B1 * | 3/2002 | Minter | 292/142 |
| 6,374,651 | B1 * | 4/2002 | Thielmann et al. | 70/210 |
| 6,810,699 | B2 * | 11/2004 | Nagy | 70/107 |
| 6,971,686 | B2 * | 12/2005 | Becken | 292/39 |
| 6,983,962 | B2 * | 1/2006 | Keightley | 292/144 |
| 6,994,383 | B2 * | 2/2006 | Morris | 292/160 |
| 7,096,697 | B2 * | 8/2006 | Keightly | 70/279.1 |
| 7,305,800 | B1 * | 12/2007 | Calfee | 52/203 |
| 7,878,034 | B2 * | 2/2011 | Alber et al. | 70/107 |
| 7,905,521 | B2 * | 3/2011 | Liang et al. | 292/51 |
| 2003/0159478 | A1 * | 8/2003 | Nagy | 70/107 |
| 2004/0231660 | A1 * | 11/2004 | Nakamura | 126/600 |
| 2004/0239121 | A1 * | 12/2004 | Morris | 292/39 |
| 2007/0158951 | A1 * | 7/2007 | Ramsauer et al. | 292/39 |
| 2007/0284893 | A1 * | 12/2007 | Davies | 292/336.3 |
| 2008/0156049 | A1 * | 7/2008 | Topfer | 70/107 |

FOREIGN PATENT DOCUMENTS

| | | | |
|---|---|---|---|
| FR | 2 783 858 | A1 | 3/2000 |
| JP | 10-176450 | A | 6/1998 |

* cited by examiner

LOCK MECHANISM FOR A HINGED LEAF OF A DOUBLE DOOR OR GATE

The present invention relates to a lock mechanism suitable for locking a first hinged leaf of a double door or gate to a ground surface. It comprising a frame arranged to be fixed within an upright tubular member of the first leaf, a bolt member movably mounted on said frame between a projected and a retracted position, and operator means connected by means of a bolt operating mechanism to the bolt member for moving it from its projected to its retracted position and vice versa. The bolt member is arranged to project through one extremity of the tubular member out of this tubular member into a hole in the ground to immobilize the leaf. The bolt operating mechanism comprises a gear train to increase the travel of the bolt member so that the door or gate can also be installed above an inclined ground surface.

It is known to secure double gates or doors by using a cane bolt on a first leaf of a double door or gate, which bolt can be extended past the lower surface of the leaf and into an opening in the ground. When the cane bolt is in this lowered position, the first leaf cannot be opened. The cane bolt often includes an angled upper end that can be grasped by a user to lift the bolt from the ground so that the leaf can be opened. An example of such a cane bolt is disclosed in EP-A-1 411 197. The first or second leaf of the double door or gate also includes another lock for securing the first leaf to the second leaf. This other lock may be an ordinary key-operated lock with a sliding bolt that extends between the first and second leafs. The first leaf is thus secured with respect to the ground and the second leaf is secured to the first leaf.

A drawback of such cane bolts is that they are mounted on the leaf so that they remain entirely visible. The present invention relates however to a lock mechanism which can be arranged at least partially within an upright tubular member of the leaf. Such a lock mechanism is already disclosed in JP-A-10/176,450. This known lock mechanism comprises a bolt member which is slidably mounted on a frame within a tubular upright of the hinged leaf. The bolt member is operated by means of a drive slider, more particularly by means of a lug on this drive slider which projects through a slot out of the tubular upright. In this way, the drive slider can be moved up and down. The drive slider comprises a rack portion which engages a first gearwheel of a gear train to convert the translational motion of the drive slider into a rotational motion. The second gearwheel of the gear train engages a rack portion on the bolt member to transform the rotational motion of the gearwheel again into a translational motion of the bolt member. The gear train between the drive slider and the bolt member is intended to increase the travel of the bolt member. The travel of the bolt member is more particularly twice as large as the travel of the drive slider. Due to the increased travel of the bolt member, the leaf can be arranged above an inclined ground surface.

A drawback of the lock mechanism disclosed in JP-A-10/176,450 is that quite a large slot has to be made in the lateral side of the tubular upright in order to be able to insert the lock mechanism into the tubular upright. In fact, the entire lock mechanism is inserted through this slot into the upright. Making such a large slot in the tubular upright is quite laborious and weakens moreover the strength of the upright. The length of the drive slider and of the bolt member is further limited by the length of the slot in the tubular upright so that the lock mechanism has to be mounted at a relatively small height above the ground. It is thus not so user friendly. A further drawback of this lock mechanism is that it can quite easily be unlocked by intruders. Indeed, even when the double door or gate is closed, the drive slider can be lifted for example by means of a pair of pointed pincers through the gap which is present between the lateral sides of the two leafs. Still a further drawback is that once the bolt member is installed in the upright, only a small adjustment (fine tuning) of the distance over which the bolt member projects out of the upright is possible by screwing the distal portion of the bolt member further into or out of the proximal portion thereof.

An object of the present invention is therefore to provide a new lock mechanism of the above defined type, which can be installed within an upright tubular member of a leaf of a double door or gate without having to make a large slot therein and which can be prevented quite easily form being unlocked when the first leave of the double door or gate is locked to the second leaf.

To this end, the lock mechanism according to the present invention is characterised in that the operator means are part of a first subunit which is arranged to be fixed on an outer face of said tubular member and in that the frame, the bolt member and the bolt operating mechanism are part of a second subunit which is arranged to be fixed within said tubular member, the lock mechanism further comprising a rotary shaft enabling to couple the bolt operating mechanism to the operator means through a hole in said tubular member, and the operator means comprising a hinged lever movable between a pushed in position and a pulled out position, the bolt member moving from its projected to its retracted position when the lever is moved from its pushed in to its pulled out position and vice versa.

Since the lock mechanism comprises a rotary shaft which enables to couple the bolt operating mechanism to the operator means, the second, internal subunit of the lock mechanism can first be inserted into the tubular member of the hinged leaf before connecting the first, outer subunit thereto. The internal subunit can thus be inserted through one extremity of the tubular member so that it is not required to make a large slot therein. Since both subunits are connected to one another by means of a rotary shaft, only a relatively small hole has to be made in the tubular member. Such a small hole can easily be drilled therein.

A further advantage of the lock mechanism according to the invention is that the hinged lever can easily be blocked between the two facing edges of the two leafs of the double door or gate when both leafs are closed. The hinged lever can more particularly be blocked in its pushed in position wherein the bolt member is in its projected position and wherein the first hinged leaf is thus secured with respect to the ground. Consequently, in order to be able to unlock the lock mechanism, the second hinged leaf has first to be opened, for example by means of a key when a key-operated lock is provided to lock the second leaf. No further lock (for example no padlock) is required to lock the lock mechanism of the first leaf so that once the second leaf is unlocked and opened, the first leaf can also be easily opened.

Another advantage of the lock mechanism according to the invention is that since the second subunit can be inserted in the tubular member through one extremity thereof, the length of the bolt member can be chosen freely and more particularly in such a manner that the hinged lever is on such a height that it can easily be operated to unlock the lock mechanism. The operator means can even be made integral with the reception element provided on the first leaf for receiving the bolt or bolts of the lock which is usually provided on the second leaf of a double door or gate.

The present invention also relates to a hinged leaf which comprises a tubular member provided with a lock mechanism according to the invention and furthermore to a method for installing a lock mechanism according to the invention onto a tubular member of a hinged leaf. This method is characterised in that said second subunit is inserted in said tubular member through one extremity thereof, the first subunit is coupled by means of said rotary shaft to the second subunit and the first subunit is fixed on an outer face of the tubular member.

Other particularities and advantages of the invention will become apparent from the following description of some particular embodiments of the lock mechanism according to the present invention. The reference numerals used in this description relate to the annexed drawings wherein.

The lock mechanism according to the invention is intended to secure a first hinged leaf 1 of a double door or gate with respect to the ground. When the first leaf 1 consists of two hinged leaf portions mounted on top of one another, the lock mechanism can however also be used to secure the upper leaf portion with respect to the lower leaf portion.

Figure 1:
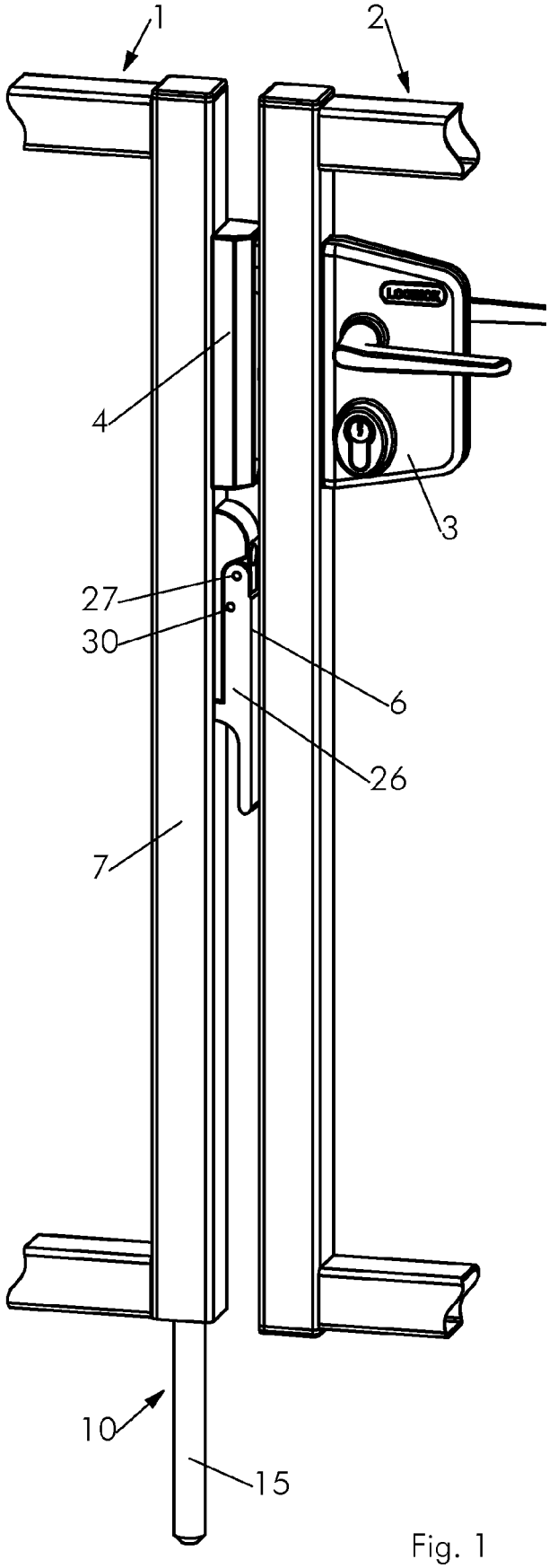
FIG. 1 is a perspective view on the two adjacent edges of two leafs of a double gate, the first leaf being provided with a lock mechanism according to the invention to secure the first leaf with respect to the ground and the second leaf being provided with a prior art key-operated lock for securing it to the first leaf.

FIG. 1 illustrates the two adjacent portions of the first 1 and second leafs 2 of a double gate in its closed position. The first leaf 1 is secured with a lock mechanism according to the invention with respect to the ground whilst the second leaf 2 is secured by means of a key-operated lock 3 to the first leaf 1, more particularly to a keeper or strike box which is fixed to the first leaf 1 and which includes a reception element 4 for receiving the bolt or bolts (dead bolt and latch bolt) of the lock 3 and an abutment element 5 for stopping the second leaf 2. Suitable locks 3 and keepers are described for example in EP0606196, EP0963498, EP1600584, EP1657383 and EP1526235.

The lock mechanism illustrated in the drawings comprises a first subunit 6 which is arranged to be mounted on an outer face of an upright tubular member 7 of the first leaf 1 and a second subunit 8 which is arranged to be mounted within this tubular member 7.

Figure 5:
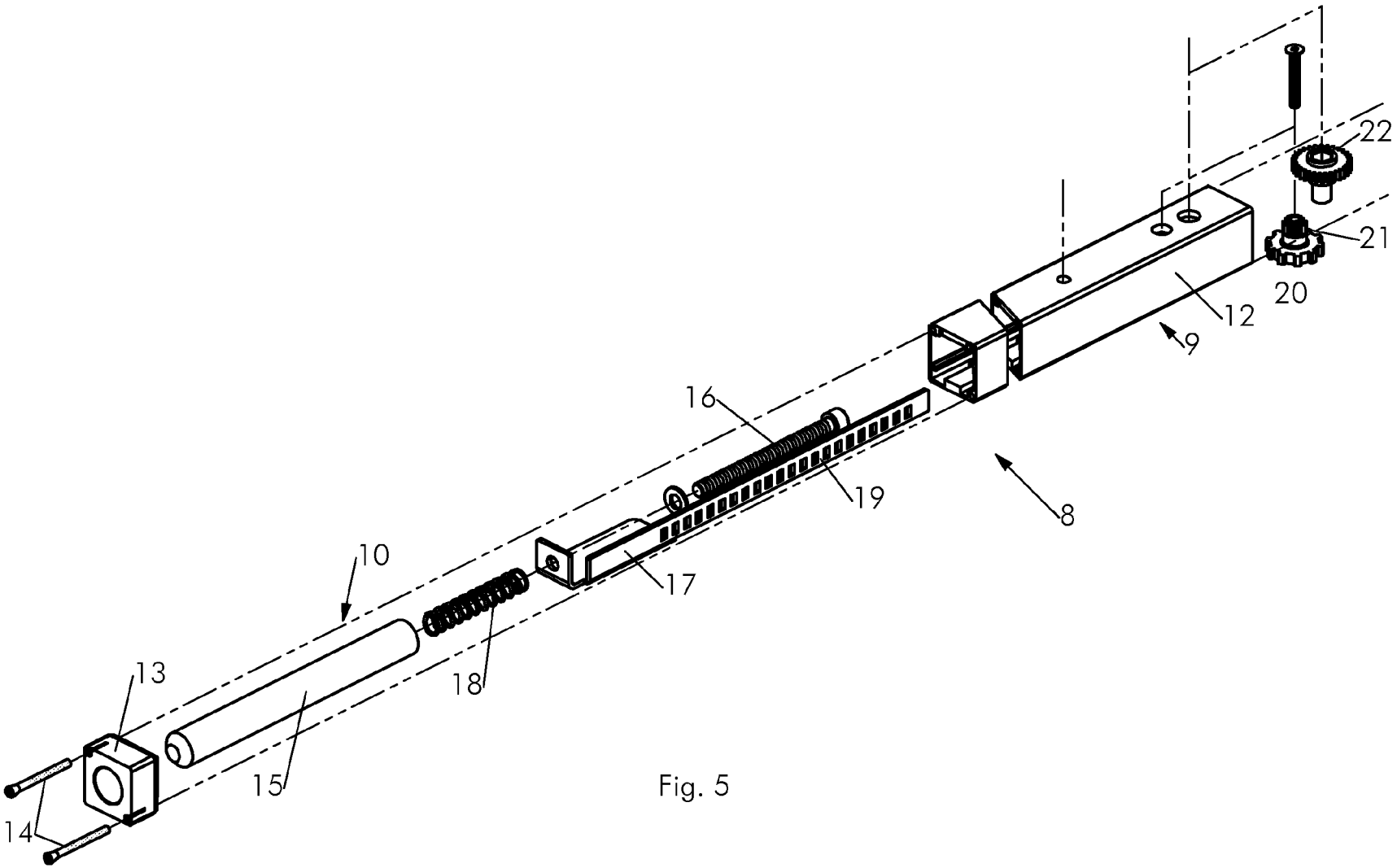
Figure 6:
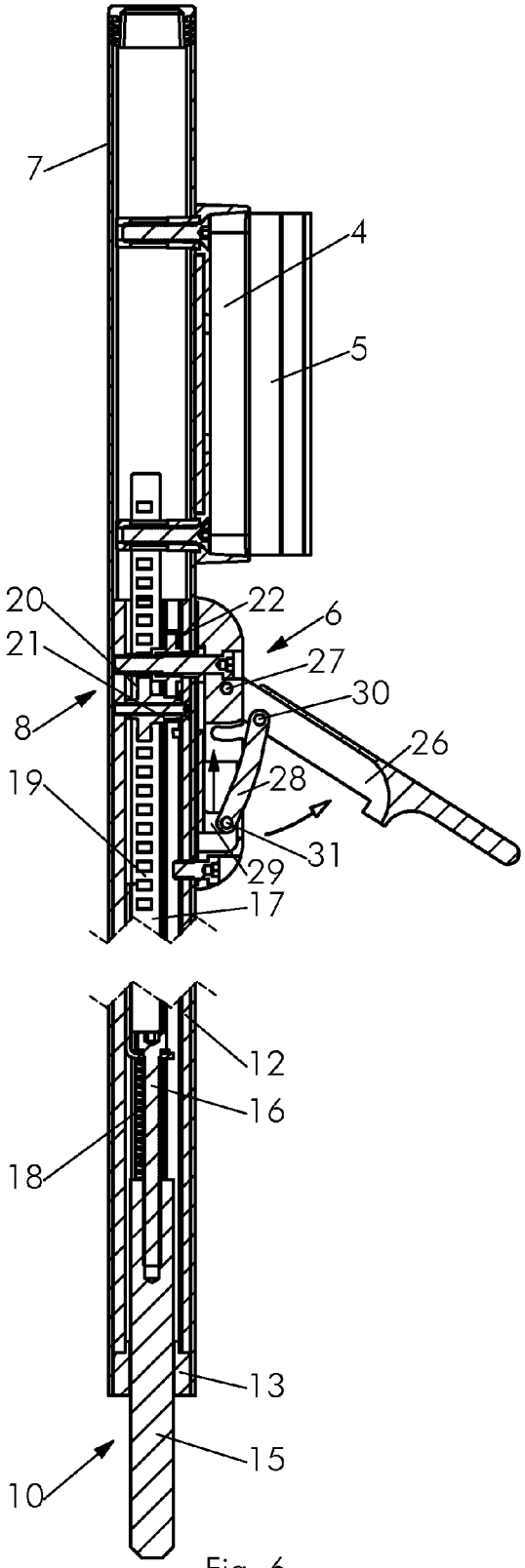
FIGS. 6 to 8 are longitudinal sectional views through the upright tubular member of the first leaf in and onto which the lock mechanism illustrated in the previous figures is installed, the initial unlocking phase being illustrated (the bolt member just having left its projected position)
Figure 7:
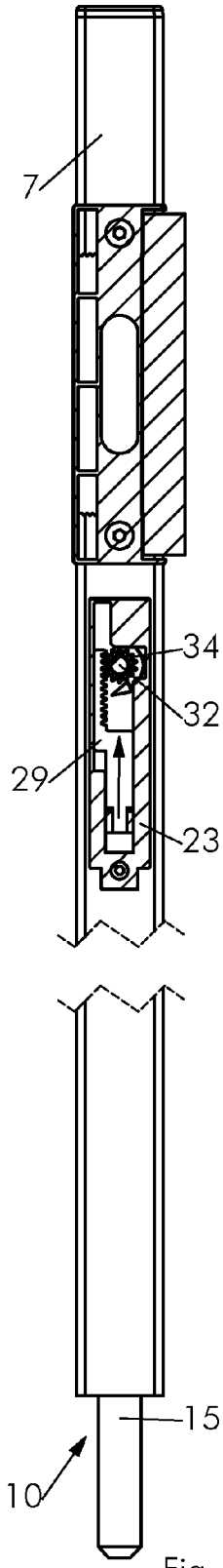
Figure 8:
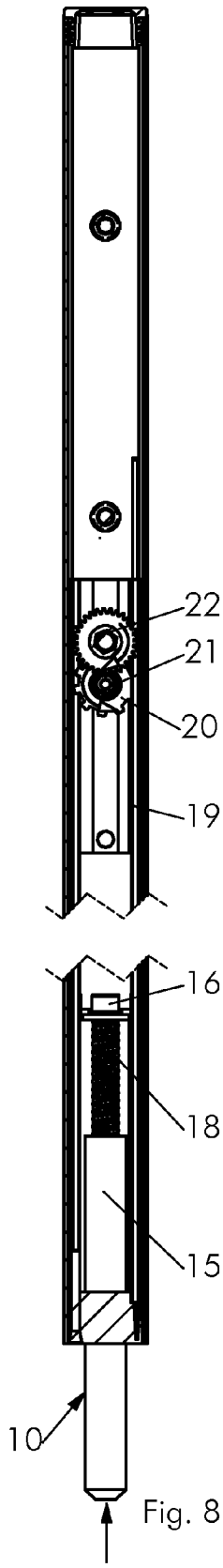
Figure 9:
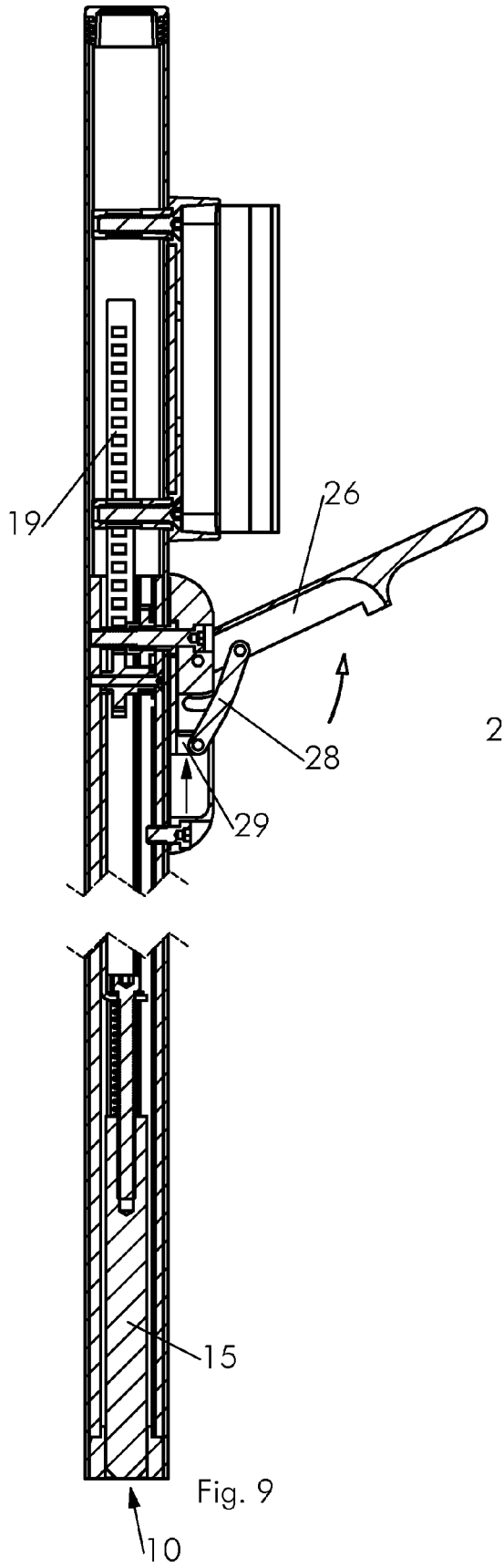
FIGS. 9 to 11 are the same views as FIGS. 6 to 8 but illustrate the final unlocking phase, the bolt member being in its retracted and the lever in its pulled out position.
Figure 10:
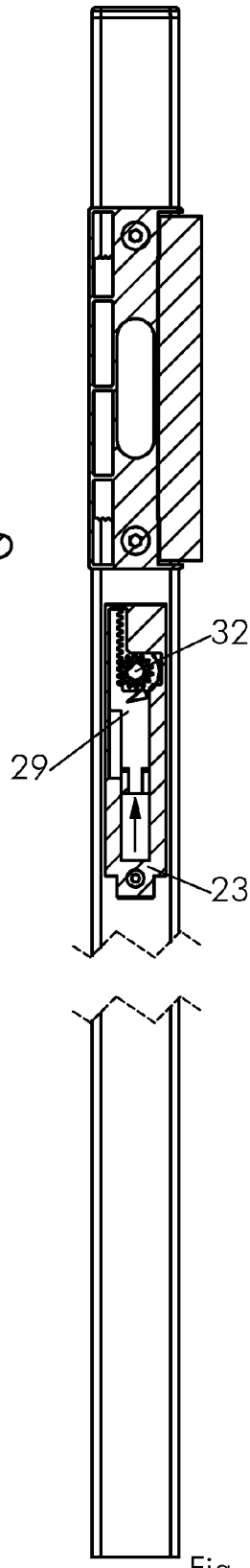
Figure 11:
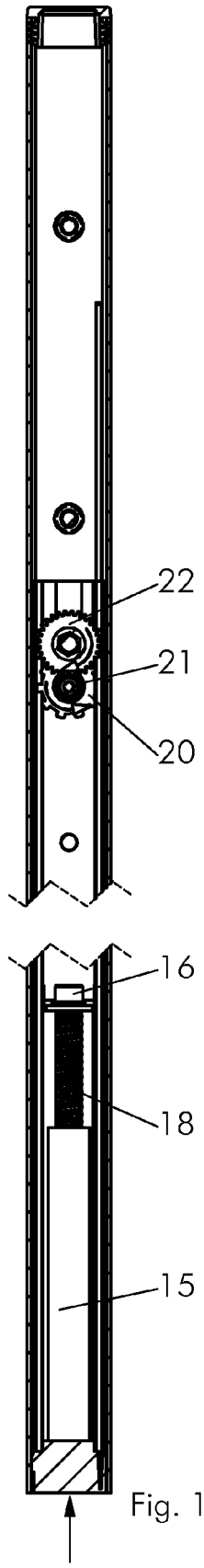
Figure 12:
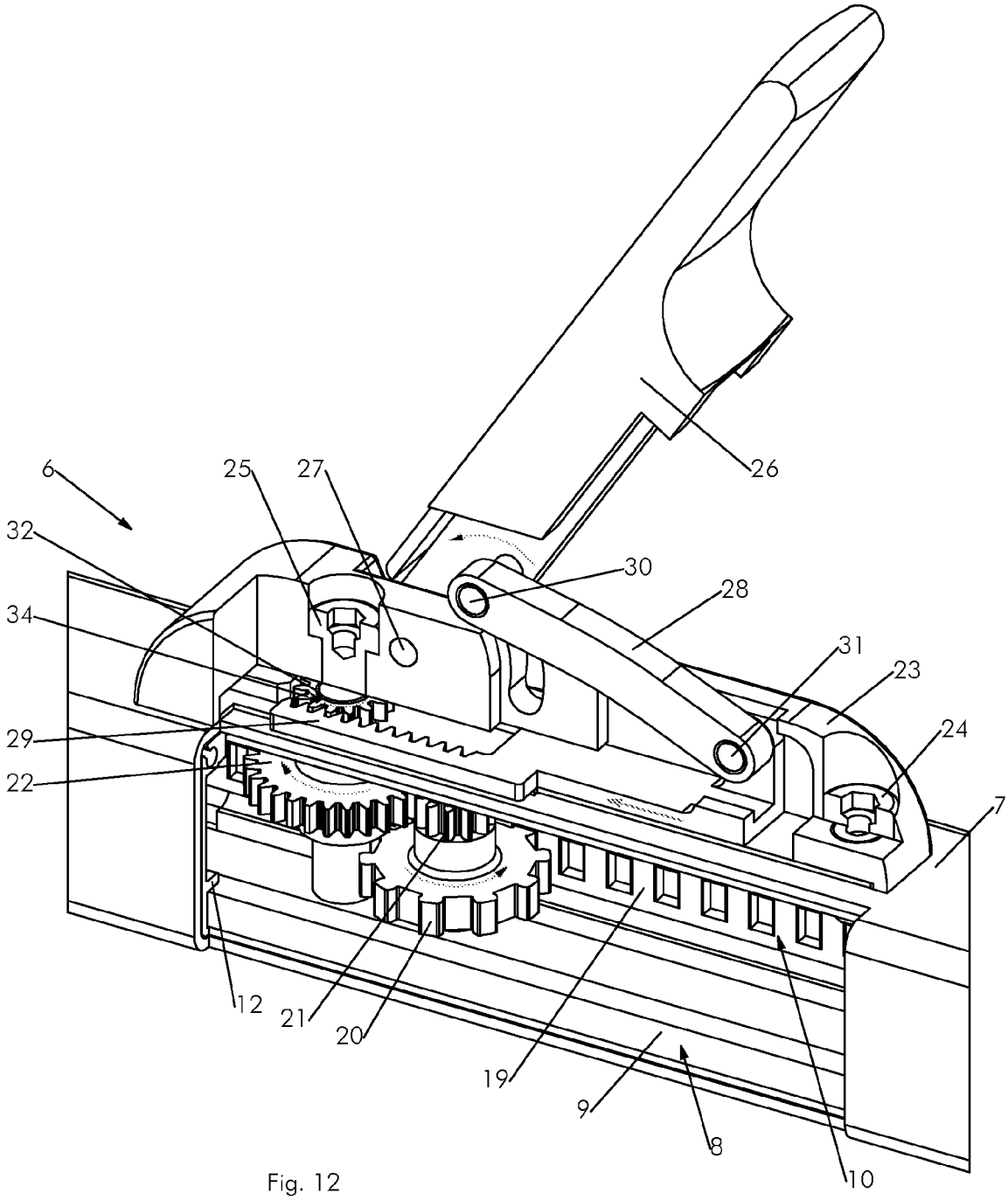
FIG. 12 is, on a larger scale, a partially cutaway perspective view on a portion of the lock mechanism mounted in and on the upright tubular member of the first leaf.

This second subunit 8, illustrated more in detail in FIG. 5, comprises a tubular frame 9, a bolt member 10 mounted on this frame 9 so that it can move between a projected and a retracted position, and a bolt operating mechanism 11 for moving the bolt member 10 from its projected to its retracted position and vice versa. The second subunit 8 is to be mounted in such a manner in the upright tubular member 7 of the first leaf 1 that the bolt member 10 projects at least in its projected position through one extremity of the tubular member 7 out of this tubular member.

The frame 9 consists of a tubular portion 12 (extruded tubular profile) and of a lid portion 13 which can be screwed by means of screws 14 onto the tubular portion 12. The lid portion 13 is provided with a circular opening through which the bolt member 10 is guided.

The bolt member 10 comprises a first portion consisting of an actual bolt 15 which projects with one extremity out of the tubular member 7 of the leaf 1 and of a screw 16 which is screwed in an axial hole in the other extremity of the bolt 15. The bolt member 10 further comprises a second portion formed by an elongated element 17 which is slidably fixed by means of the screw 16 to the actual bolt 15. A resilient member, more particularly a compression spring 18 is applied over the screw 16 between the elongated element 17 and the bolt 15 to urge the two bolt member portions apart.

The elongated element 17 of the bolt member 10 is arranged to cooperate with the bolt operating mechanism 11. It comprises more particularly a rack portion 19 whilst the bolt operating mechanism 11 comprises a gear train, one gearwheel 20 of which being arranged to engage the rack portion 19 for transforming a rotational motion of this gearwheel 20 into a translational motion of the bolt member 10. The gear train of the bolt operating mechanism 11 further comprises a smaller gearwheel 21 which is co-axial with and fixed to the driven gearwheel 22 and a larger drive gearwheel 22 which engages the smaller gearwheel 21. The number of rotations of the driven gearwheel 20 is thus greater than the number of rotations of the drive gearwheel 22 so that the gear train provides for an increased travel of the bolt member 10. The gear train is preferably selected so that the travel of the bolt member 10 comprises at least 8 cm, more preferably at least 10 cm and most preferably at least 12 cm. In this way the double door or gate can be installed above a quite inclined surface without having to provide a raised ground surface portion for the reception hole of the bolt.

Figure 4:
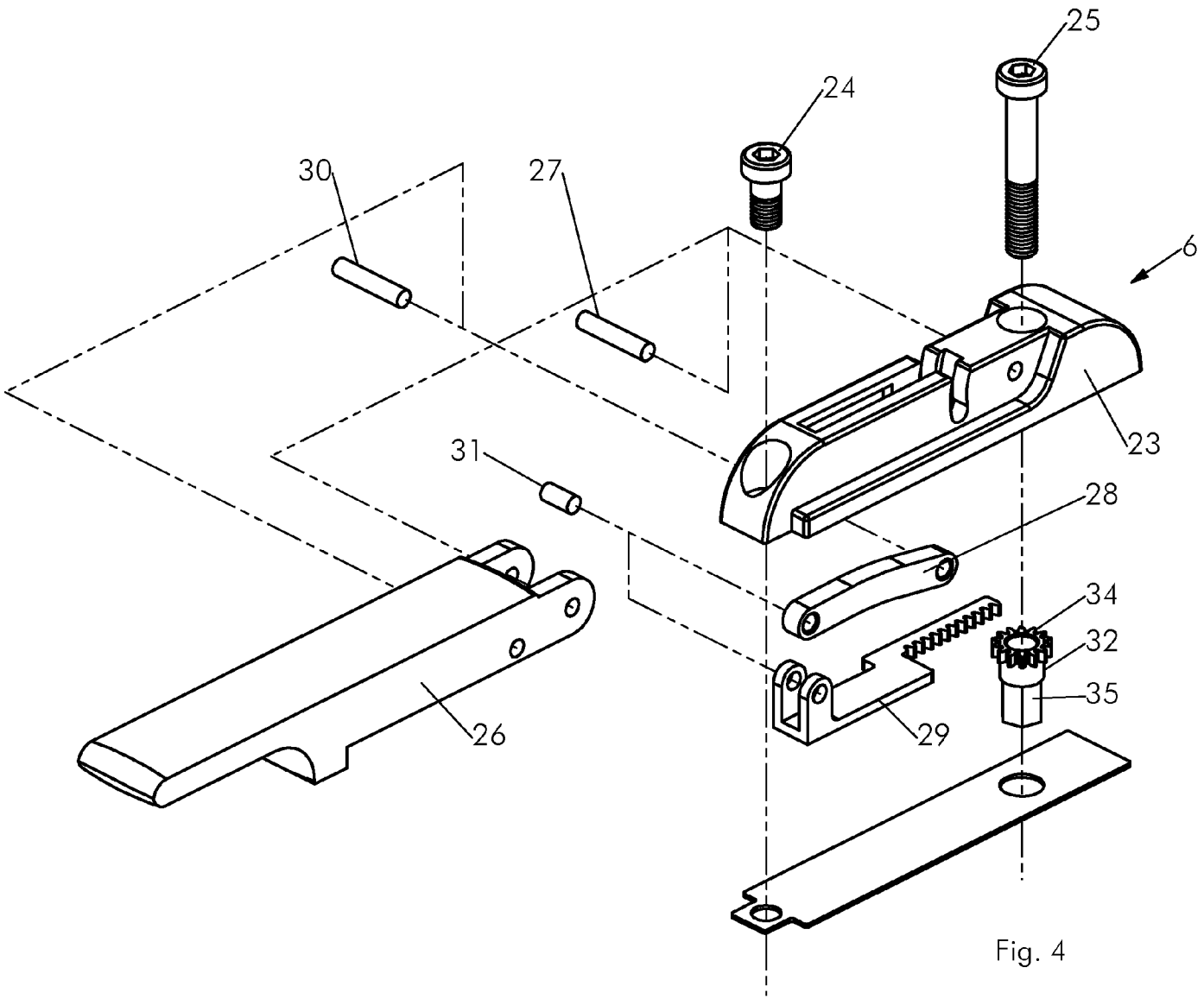
FIGS. 4 and 5 are, on a larger scale, exploded views of respectively the first and second subunits of the lock mechanism illustrated in the previous figures.

The first subunit 6 of the lock mechanism, which is provided to be fixed on an outer face of the tubular member 7 of the first leaf 1, comprises operator means which are arranged to rotate the drive gearwheel 22 of the bolt operating mechanism so as to be able to move the bolt member 10 between its retracted and projected positions. The operator means illustrated more into detail in FIG. 4 comprise a frame 23 which can be fixed by means of screws 24 and 25 onto the tubular member (the screws are screwed more particularly through holes in this tubular member into treaded holes in the frame of the second subunit) and a lever 26 hinged about a shaft 27 on this frame 23. The lever 26 can move between a pushed in and a pulled out position and is connected by a connecting arm 28 to a rack member 29. One extremity of the connecting arm 28 is hinged about a first shaft 30 on the lever 26 whilst the second extremity of the connecting arm 28 is hinged about a second shaft 31 on the rack member 29. When moving the lever 26 between its pushed in and pulled out positions, the rack member 29 is thus moved according to a translational motion.

In order to be able to couple the outer subunit 6 to the inner subunit 8, the lock mechanism further comprises a rotary shaft 32 by means of which the operator means 26, 28, 29 can be coupled through a hole 33 in the tubular member 7 to the bolt operating mechanism 20, 21, 22. One extremity of the rotary shaft 32 is provided with a pinion 34 which engages the teeth of the rack member 29 so that the translational motion of the rack member 29 is transformed into a rotational motion of the rotary shaft 32. The other extremity 35 of the rotary shaft 32 is non-circular (for example hexagonal) and is arranged to be received in a corresponding non-circular recess 36 in the shaft of the drive gearwheel 22 of the gear train. The rotation axis of the rotary shaft 32 coincides with the rotation axis of the drive gearwheel 22 so that the rotational motion of the rotary shaft 32 can be transmitted to the drive gearwheel 22.

An important feature of the lock mechanism according to the invention is that when the lever 26 is moved from its pushed in to its pulled out position, the bolt member 10 moves from its projected to its retracted position and, vice versa, when the lever 26 is moved from its pulled out to its pushed in position, the bolt member 10 moves from its retracted to its projected position. This can be seen clearly in FIGS. 6 to 12.

The lock mechanism described hereabove can easily be mounted in the upright tubular member 7 of the first leaf 1 without having to make a large slot therein. Before the second subunit 8 is coupled by means of the rotary shaft 32 to the first subunit 6, the second subunit 8 can simply be inserted through the open extremity of the tubular member 7 into this tubular member. The second subunit 8, more particularly the tubular frame portion 12 thereof, is preferably sized so that it can be inserted in a square tubular member 7 having an inner size of 4 by 4 cm. The face of the tubular member 7 directed towards the second leaf 2 has only to be provided with two holes, namely with the hole 33 for the rotary shaft 32 and with a hole 37 for the screw 24. These holes can easily be drilled in the tubular member 7.

Figure 2:
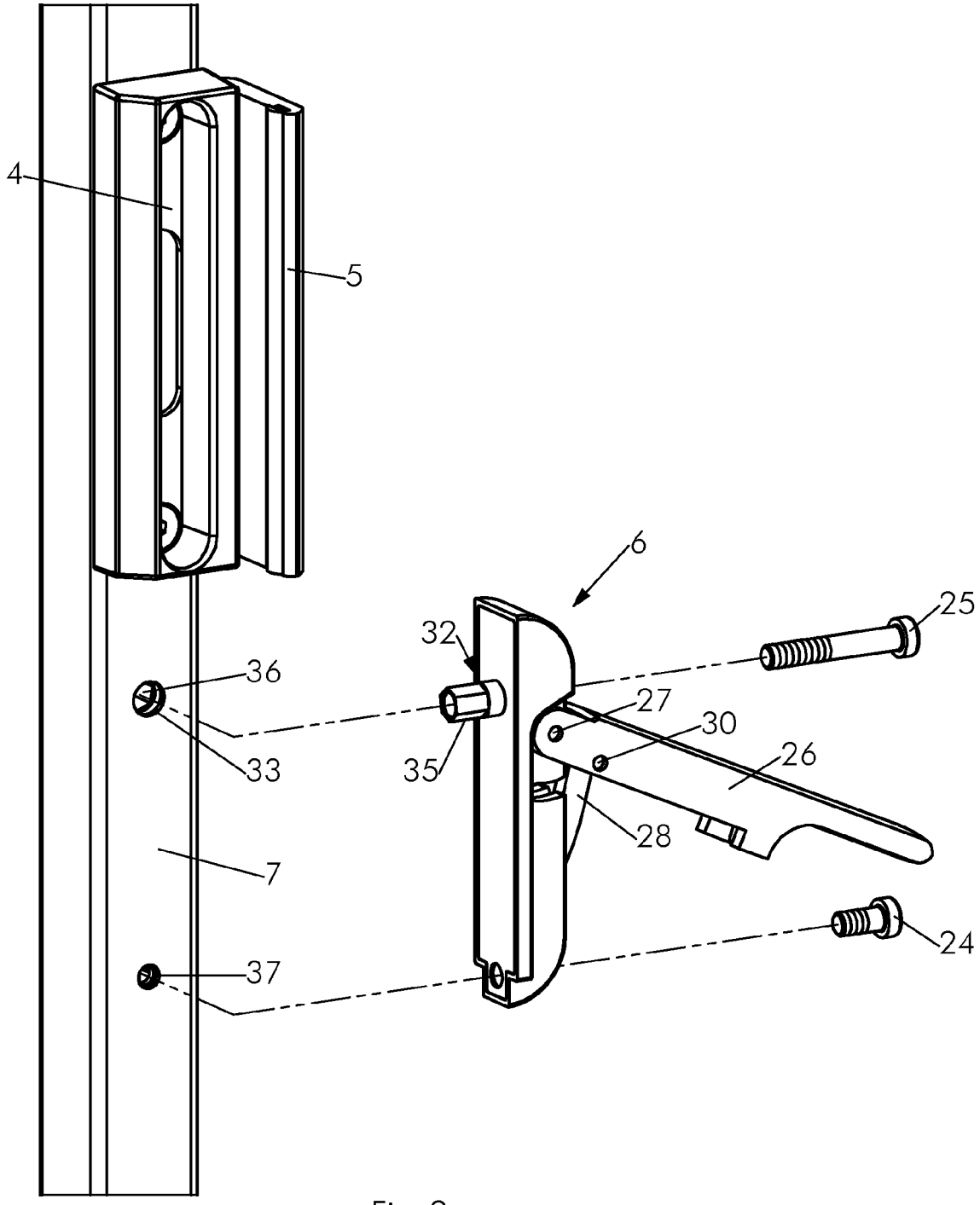
FIG. 2 is a partially exploded view of the lock mechanism illustrated in FIG. 1, wherein the first subunit is removed from the upright tubular member of the first leaf whilst the second subunit is still in this tubular member.
Figure 3:
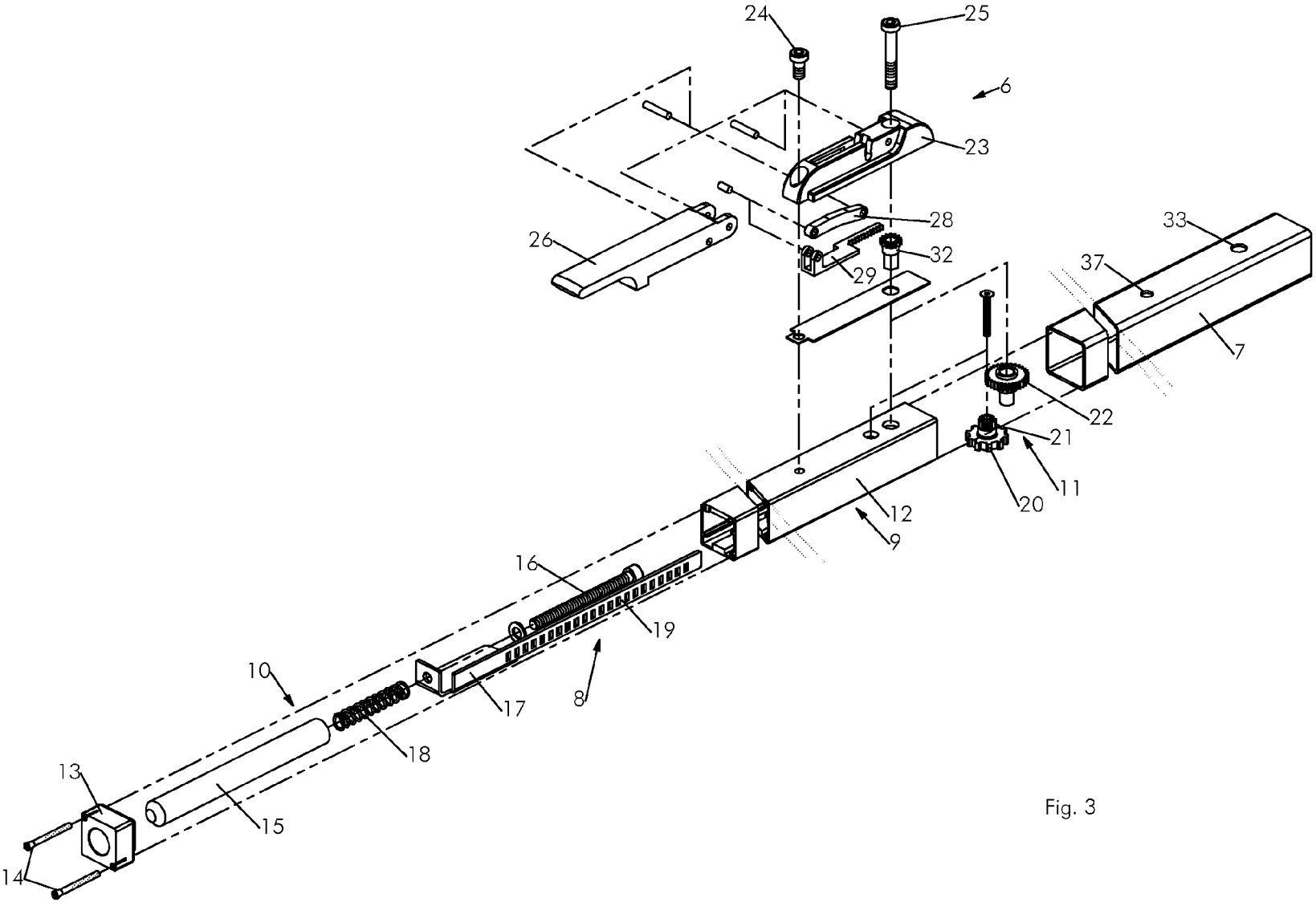
FIG. 3 is an exploded view of the lock mechanism illustrated in the previous figures.

After having inserted the second subunit 8 into the tubular member 7, as illustrated in FIG. 2, it is possible to adjust the distance over which the bolt member 10 projects out of the tubular member 7. A hexagonal key can be inserted through the hole 33 into the hexagonal recess in the first gearwheel 22 of the gear train and can be rotated until the bolt member 10 is at the required height above the ground level. In a next step the first subunit 6 provided with the rotary shaft 32 is mounted by means of the screws 24 and 25 onto the tubular member 7. Both the rotary shaft 32 and the first gearwheel 22 are provided with an axial hole for the screw 25 so that the screw 25 can be fixed through these axial holes and serves as rotation shaft for the rotary shaft 32 and for the first gearwheel 22.

The first subunit 6 with the lever 26 is preferably fixed onto the lateral side of the first leaf 1 which is directed towards the second leaf 2. In this way, when the double door or gate is closed (as illustrated in FIG. 1), the lever 26 is locked between the two facing lateral sides of the two leafs 1, 2, more particularly in its pushed in position wherein the bolt member 10 is in its projecting position thus securing the first leaf with respect to the ground. Only after having unlocked and opened the second leaf 2 by means of the lock 3, the lever 26 can be lifted to unlock also the first leaf 1. In the illustrated lock mechanism, the lever 26 is pivotally mounted about an axis (axis of shaft 27) which defines an angle greater than 45°, more particularly an angle of about 90° with respect to the front face of the first leaf 1 so that the lever can effectively be blocked between both leafs 1, 2 of the double door or gate.

Instead of mounting the first subunit 6 onto the lateral side of the first leaf, it could also be mounted onto the front or the back side of this leaf, optionally even in a tubular member fixed to the front or back side of the leaf. However, the lever would then not be blocked between the two leafs unless it would be shaped so that its free extremity would extend between the two leafs. In this case, the lever could pivot directly about the longitudinal axis of the rotary shaft so that the rack member 29 could be omitted.

Figure 14:
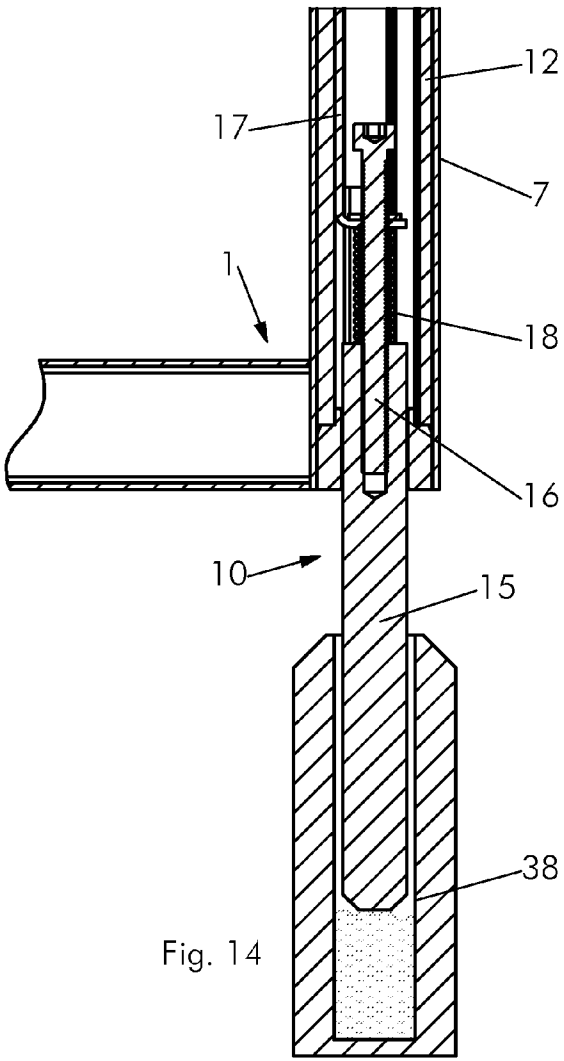
FIG. 14 is the same view as FIG. 11 but illustrates the situation when the reception hole is partially filled with dirt.
Figure 13:
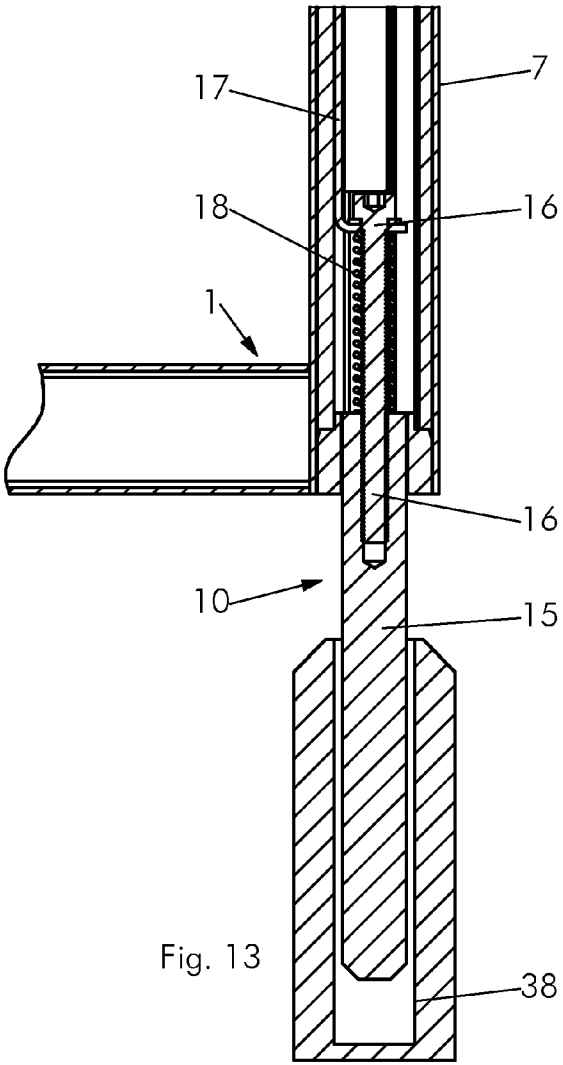
FIG. 13 is a longitudinal sectional view of the lower portion of the tubular member wherein the lock mechanism is mounted, the distal extremity of the bolt member projecting in a reception hole in the ground.

FIGS. 13 and 14 illustrate the functioning of the bolt member when it is inserted in an empty reception hole 38 in the ground and when it is inserted in a reception hole 38 which is partially filled with dirt. The empty reception hole 38 enables the bolt 15 of the bolt member 10 to move entirely to its projected position. When the reception hole is partially filled, as illustrated in FIG. 14, the bolt 15 slides with respect to the elongated bolt portion 17 so that the spring 18 is compressed. In this way, the lever 26 can still be brought entirely into its pushed in position, which is necessary to be able to close the second leaf 2. In order to prevent the lever 26 from moving again towards its pulled out position under the action of the compression spring 18, the connecting arm 28 is fixed in such a manner to the lever 26 that when the lever 26 moves between its pushed in and pulled out positions, it passes a dead centre (see FIGS. 1 and 6). In this way, when the compression spring 18 is compressed, this spring 18 urges the lever 26 towards its pushed in position when it is in its pushed in position.

An advantage of the lock mechanism described hereabove is that the length of the second subunit 8 can be chosen so that the first subunit 6 is situated at the most appropriate height, more particularly close to the lock 3 provided on the second leaf 2. Instead of providing a separate keeper or strike box for this lock 3, this keeper can be made integral with the first subunit 6 of the lock mechanism.

Figure 15:
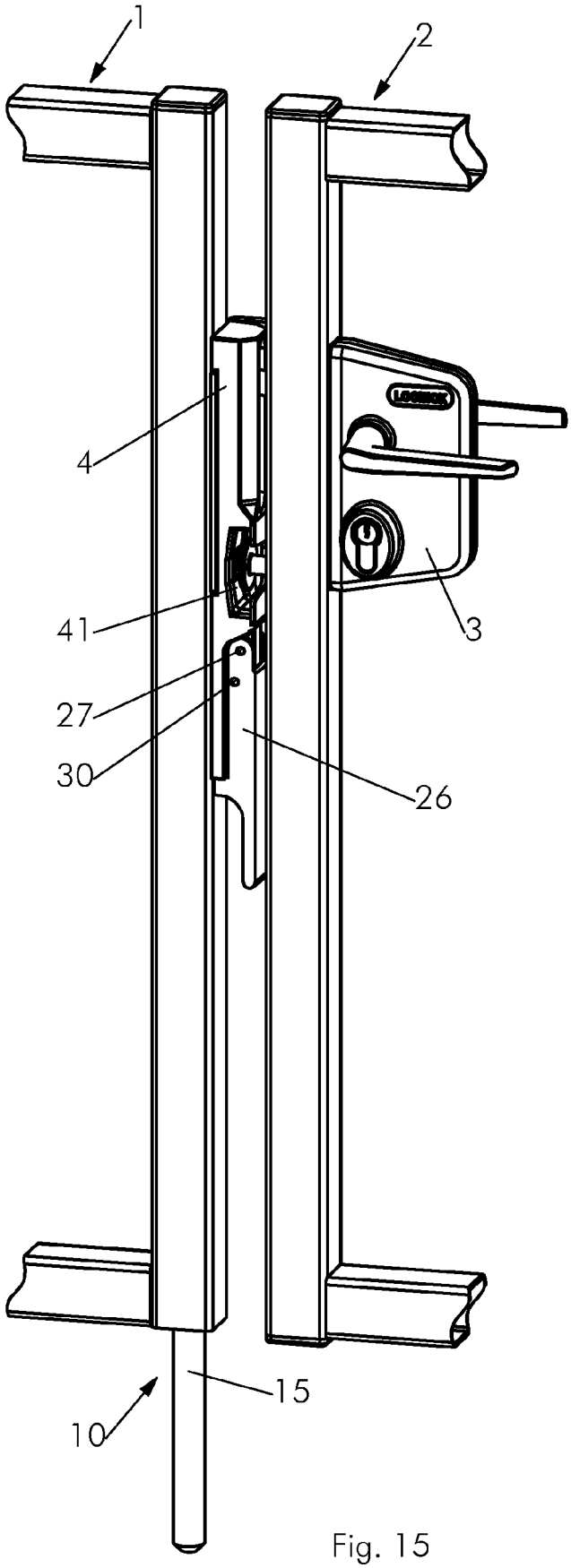
FIG. 15 is the same view as FIG. 1 but illustrates a variant embodiment of the lock mechanism wherein the first subunit is provided with a reception element for receiving the bolt of the lock on the second leaf and with an abutment element for the second leaf.
Figure 16:
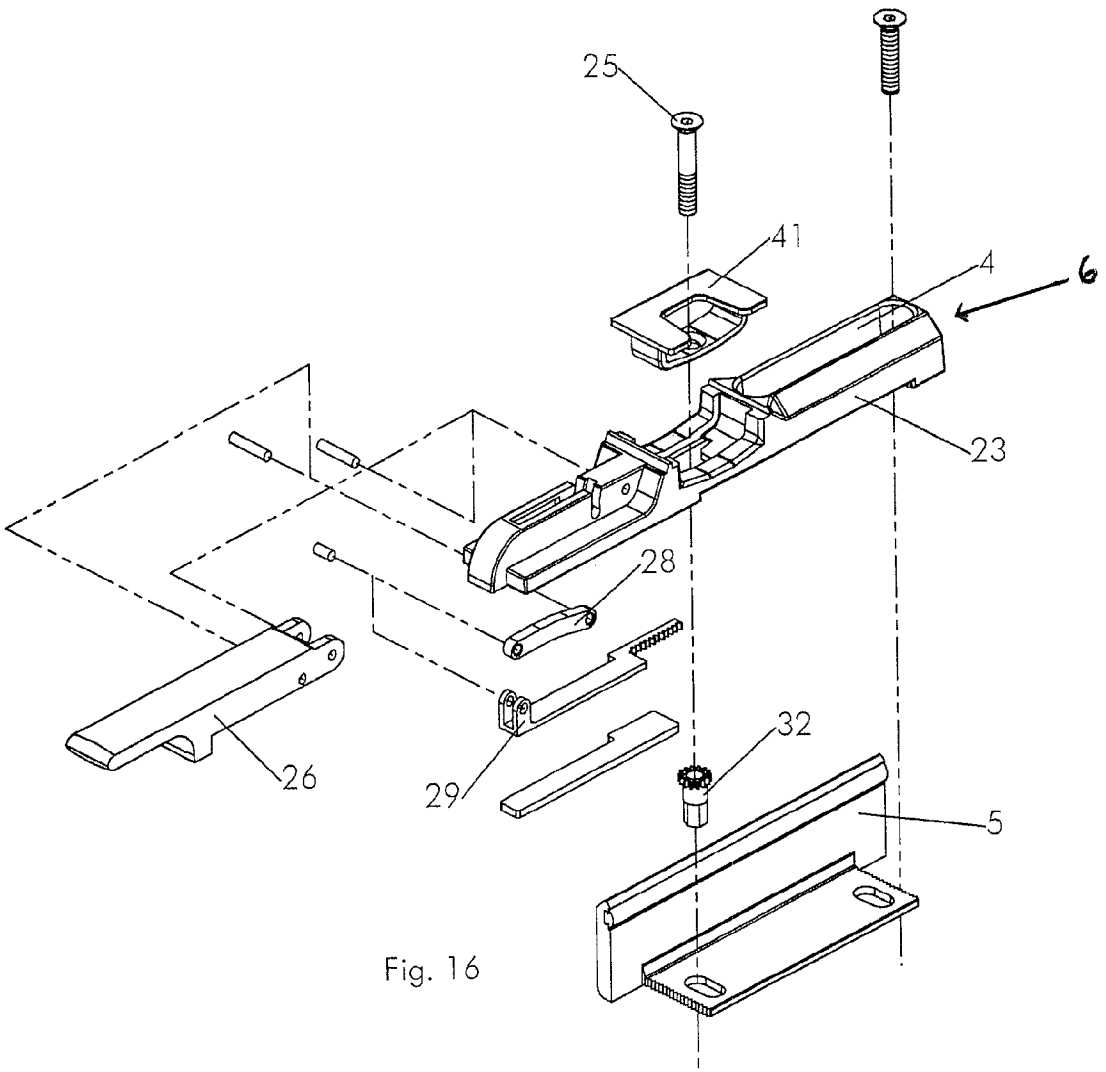
FIG. 16 is an exploded view of the first subunit of the lock mechanism illustrated in FIG. 13.

Such a variant embodiment is illustrated in FIGS. 15 and 16. The frame 23 of the first subunit 6 forms the reception element 4 for the bolts of the lock 3. The first subunit 6 further comprises the abutment element 5 for the second leaf 2 which has an L-shaped cross-section so that it can be fixed between the frame 23 and the tubular upright 7. Finally, the first subunit 6 comprises even a security mechanism 41 as disclosed in EP1600584 which assures that the two leafs cannot be forced apart.

Figure 17:
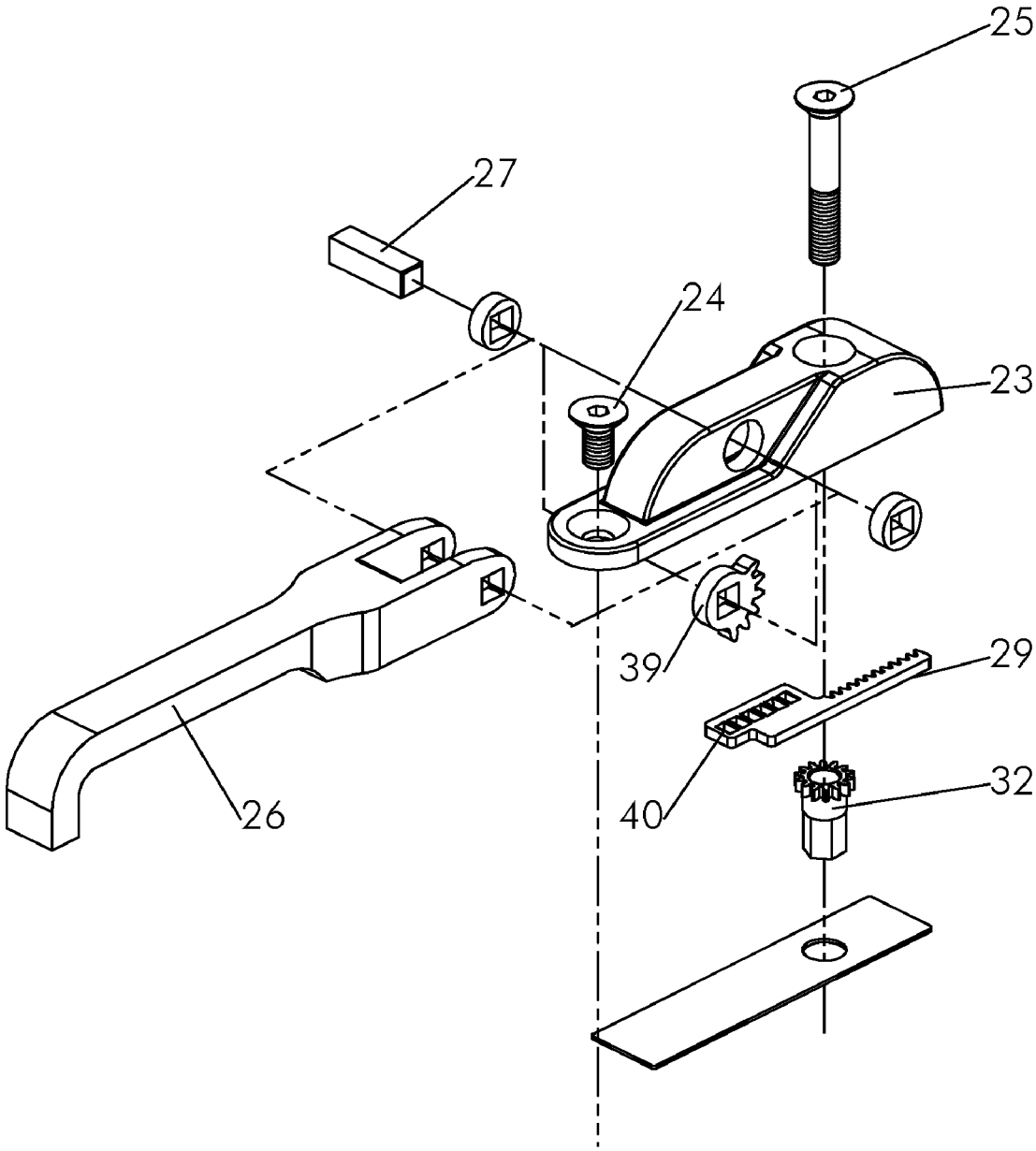
FIG. 17 is an exploded view of the first subunit of still a further variant embodiment of the lock mechanism according to the invention.
Figure 18:
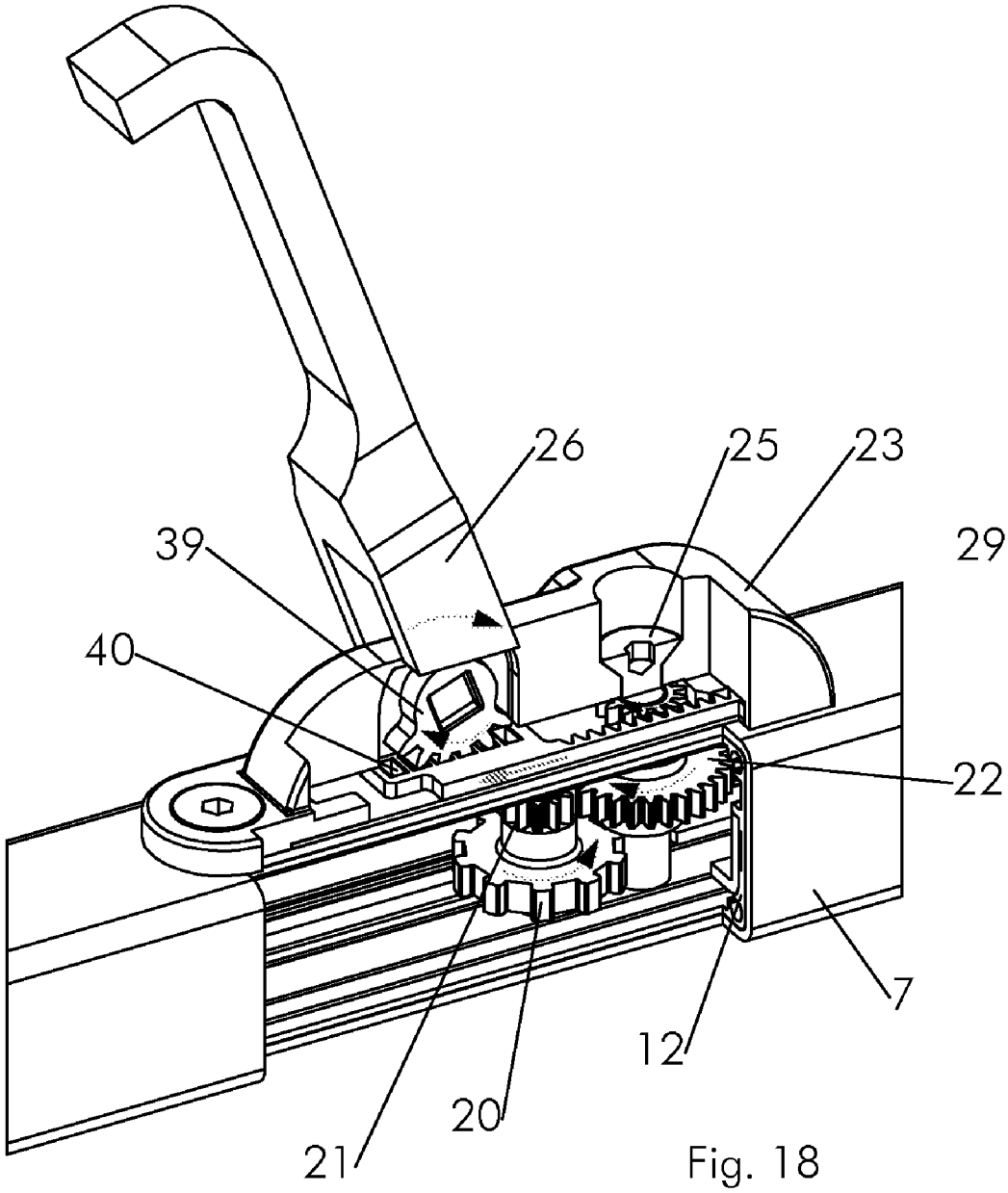
FIG. 18 is a same view as FIG. 12 but shows the variant lock mechanism illustrated in FIG. 17.

FIGS. 17 and 18 illustrate a further variant embodiment of the first subunit 6 wherein the connecting arm 28 between the lever 26 and the rack member 29 has been replaced by a gearwheel segment 39 mounted onto the rotation shaft 27 of the lever 26 so as to rotated together with this lever. The teeth of the gearwheel segment 39 engage a further rack portion 40 on the rack member 29 so that a rotational motion of the lever 26 is again transformed into a translational motion of the rack member 29.

The invention claimed is:

1. A lock mechanism suitable for locking a first hinged leaf (1) of a double door or gate and comprising:

a frame (9) arranged to be fixed within an upright tubular member (7) of the first leaf (1);

a bolt member (10) movably mounted on said frame (9) between a projected and a retracted position, the bolt member (10) being arranged to project through one extremity of said tubular member (7) out of this tubular member (7); and operator means (26, 28/39, 29) connected by means of a bolt operating mechanism (11) to the bolt member (10) for moving it from its projected to its retracted position and vice versa, which bolt operating mechanism (11) comprises a gear train (20, 21, 22) providing an increased travel of the bolt member (10), wherein said operator means are part of a first subunit (6) which is arranged to be fixed on an outer face of said tubular member (7); and wherein said frame (9), said bolt member (10) and said bolt operating mechanism (11) are part of a second subunit (8) which is arranged to be fixed within said tubular member (7), the lock mechanism further comprising a rotary shaft (32) enabling to couple the bolt operating mechanism (11) to the operator means through a hole (33) in said tubular member (7), the rotary shaft (32) having a non-circular extremity (35) arranged to be removably inserted through said hole (33) in said tubular member (7) in a corresponding non-circular recess in the shaft of a first gearwheel (22) of said gear train so that the rotation axis of said rotary shaft (32) and the rotation axis of said first gearwheel (22) coincide and the operator means comprising a hinged lever (26) movable between a pushed in position and a pulled out position, the bolt member (10) moving from its projected to its retracted position when the lever (26) is moved from its pushed in to its pulled out position and vice versa.

2. A lock mechanism according to claim 1, wherein said operator means comprise a rack member (29) movable according to a translational motion by means of said lever (26) and gearing with a pinion (34) which is connected by means of said rotary shaft (32) to the bolt operating mechanism (11).

3. A lock mechanism according to claim 2, wherein said pinion (34) is provided on said rotary shaft (32).

4. A lock mechanism according to claim 2, wherein said operator means comprise a connecting arm (28) hinge connected to said lever (26) and to said rack member (29) to transform a pivotal motion of the lever (26) into said translational motion of the rack member (29).

5. A lock mechanism according to claim 4, wherein when the lever (26) moves between its pushed in and pulled out positions, it passes a dead centre.

6. A lock mechanism according to claim 1, wherein the bolt member (10) comprises first (15, 16) and second portions (17, 19) which are slidable relatively to one another in the direction in which the bolt member (10) moves against the action of a resilient member (18) which normally acts to urge the two portions apart.

7. A lock mechanism according to claim 1, wherein said bolt member (10) comprises a rack portion (19) and said gear train comprises a further gearwheel (20) engaging said rack portion (19) of the bolt member (10) enabling to transform a rotational motion of said further gearwheel (20) into a translational motion of the bolt member (10).

8. A lock mechanism according to claim 1, wherein the first subunit (6) comprises a reception element (4) for receiving at least one bolt of a lock (3) mounted onto a second leaf (2) of said double door or gate.

9. A lock mechanism according to claim 1, wherein the first subunit (6) comprises an abutment element (5) for a second leaf (2) of said double door or gate.

10. A lock mechanism according to claim 1, wherein leafs (1, 2) of said double door or gate have two lateral sides facing each other when the double door or gate is closed, the hinged lever (26) being arranged to be locked in its pushed in position between these two facing lateral sides when the double door or gate is closed.

11. A lock mechanism according to claim 1, wherein it is provided to be fixed onto a lateral side of said first leaf (1) which is directed, in the closed position of the double door or gate, towards a second leaf (2) of the double door or gate.

12. A lock mechanism according to claim 1, wherein said second subunit (8) is sized so that it can be inserted in a square tubular member (7) having an inner size of 4 by 4 cm.

13. A lock mechanism according to claim 1, wherein said gear train (20, 21, 22) is selected so that when the lever (26) moves from its pushed in to its pulled out position the bolt member (10) travels over at least 8 cm, preferably over at least 10 cm and more preferably over at least 12 cm.

14. A lock mechanism according to claim 1, wherein said hinged lever (26) is pivotally mounted about an axis which defines an angle larger than 45° with a front face of the first leaf (1) when the first subunit (6) is mounted thereon.

15. A hinged leaf (1) comprising a tubular member (7), wherein the tubular member (7) is provided with a lock mechanism according to claim 1.

16. A method for installing a lock mechanism according to claim 1 onto a tubular member (7) of a first hinged leaf (1), wherein said second subunit (8) is inserted in said tubular member (7) through one extremity thereof, the first subunit (6) is coupled by means of said rotary shaft (32) to the second subunit (8) and the first subunit (6) is fixed on an outer face of the tubular member (7).

* * * * *